United States Patent [19]

Oliff

[11] 4,453,664

[45] Jun. 12, 1984

[54] DUAL PURPOSE PROMOTIONAL MEANS

[75] Inventor: James R. Oliff, Austell, Ga.

[73] Assignee: The Mead Corporation, Dayton, Ohio

[21] Appl. No.: 439,384

[22] Filed: Nov. 5, 1982

[51] Int. Cl.[3] ..... G09F 3/10

[52] U.S. Cl. ..... 229/40; 40/312; 206/459; 283/105; 283/903

[58] Field of Search ..... 229/70, 37 R, 38, 39 R, 229/40, 74; 206/459; 40/312, 313; 283/105, 903

[56] References Cited

U.S. PATENT DOCUMENTS

| | | | |
|---|---|---|---|
| 223,432 | 1/1880 | Brooks | 40/312 X |
| 1,558,780 | 10/1925 | Bethan | 283/105 X |
| 2,209,657 | 7/1940 | Martin | 40/312 |
| 3,314,592 | 4/1967 | Streich | 229/74 |
| 3,397,776 | 8/1968 | Weiss | 229/40 X |
| 4,103,820 | 8/1978 | Mathison et al. | 206/459 X |
| 4,128,954 | 12/1978 | White | 206/459 X |
| 4,197,984 | 4/1980 | Hartman et al. | 229/70 X |
| 4,281,762 | 8/1981 | Hattemer | 206/459 X |
| 4,397,417 | 8/1983 | Carlson | 229/70 X |
| 4,403,689 | 9/1983 | Wood | 206/459 X |

FOREIGN PATENT DOCUMENTS

| | | | |
|---|---|---|---|
| 310901 | 9/1933 | Italy | 229/70 |

*Primary Examiner*—William Price
*Assistant Examiner*—Gary E. Elkins
*Attorney, Agent, or Firm*—Rodgers & Rodgers

[57] ABSTRACT

In a wraparound article carrier having top, bottom and side walls interconnected to form a sleeve, dual purpose promotional means is adhered to the inner surface of one of the side walls and comprises a primary coupon, a secondary coupon joined to the outer edge of the primary coupon and disposed in flat face contacting relation therewith, and a pair of glue flaps detachably joined respectively to the side edges of the secondary coupon and adhered to the one side wall.

10 Claims, 4 Drawing Figures

5
24
21
20
46
48
50
4
23
49
47
19
7
3
1
45
22
6
13
9
27
35
29
28
16
15
11
51
42
34
26
25
17
18
59
31
41
8
10
51
67

5
24
7
3
23
1
22
6
9
27
11
26
52
25
8
10

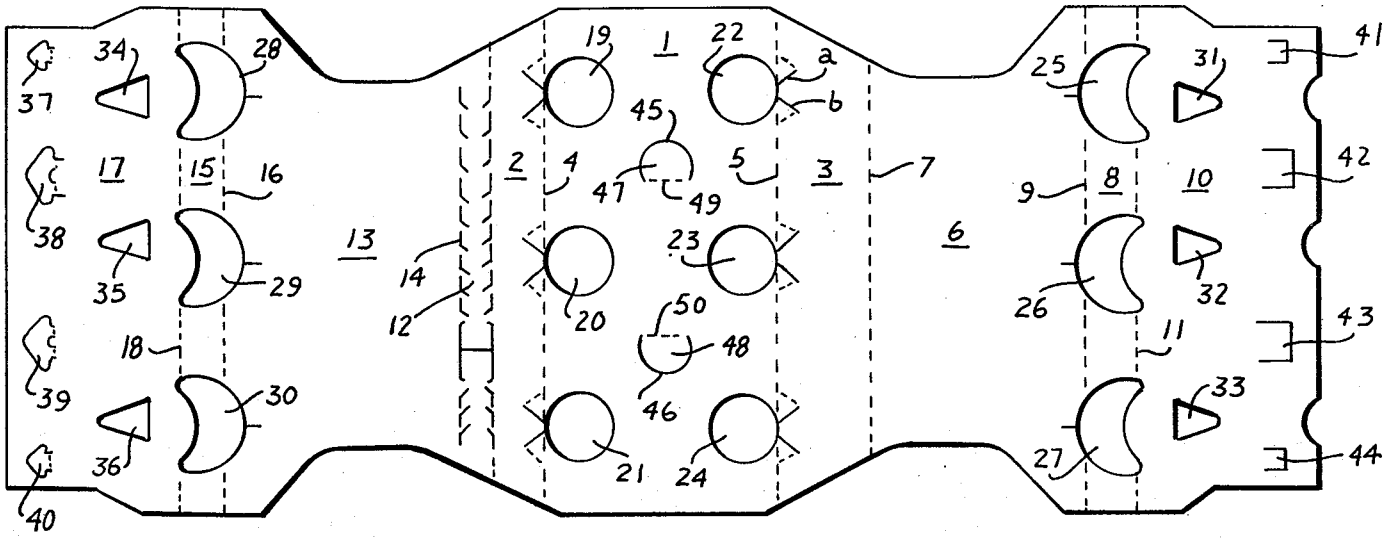
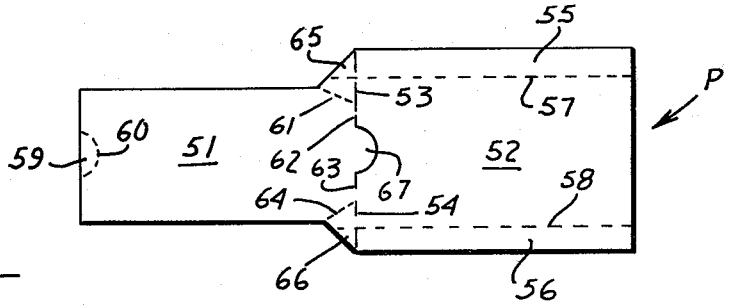
Fig. 3
Fig. 4

DUAL PURPOSE PROMOTIONAL MEANS

TECHNICAL FIELD

This invention relates to promotional means generally for use in connection with a wraparound type article carrier. Generally the invention allows for one redemption feature which can be utilized at the point of purchase and a second redemption feature which is suitable for subsequent use such as customer mail-in and the like.

BACKGROUND ART

In the past, various promotional features have been incorporated mostly in article carriers of the basket style variety. Since wraparound type article carriers are formed of a relatively small amount of paperboard material, the incorporation of promotional means in connection therewith has been severely limited. In addition many promotions have been historically unsatisfactory whenever the primary coupon is positioned in such manner that it is sensitive to abrasion because it is necessary to envelope it in a protective covering which adds undesirable cost and complexity to the carrier.

DISCLOSURE OF THE INVENTION

By this invention, promotional means is incorporated into an article carrier having top, bottom and side walls and comprises a primary coupon, a secondary coupon joined to an end edge of the primary coupon, a pair of glue flaps joined respectively to the side edges of the secondary coupon and adhered to one of the walls, and the primary coupon being disposed intermediate the secondary coupon and the one wall.

BRIEF DESCRIPTION OF THE DRAWINGS

In the drawings,

FIG. 3 is a plan view of a blank from which the article carrier is formed; and

FIG. 4 is a plan view of the blank from which the promotional means is formed according to this invention.

BEST MODE FOR CARRYING OUT THE INVENTION

Figure 1:
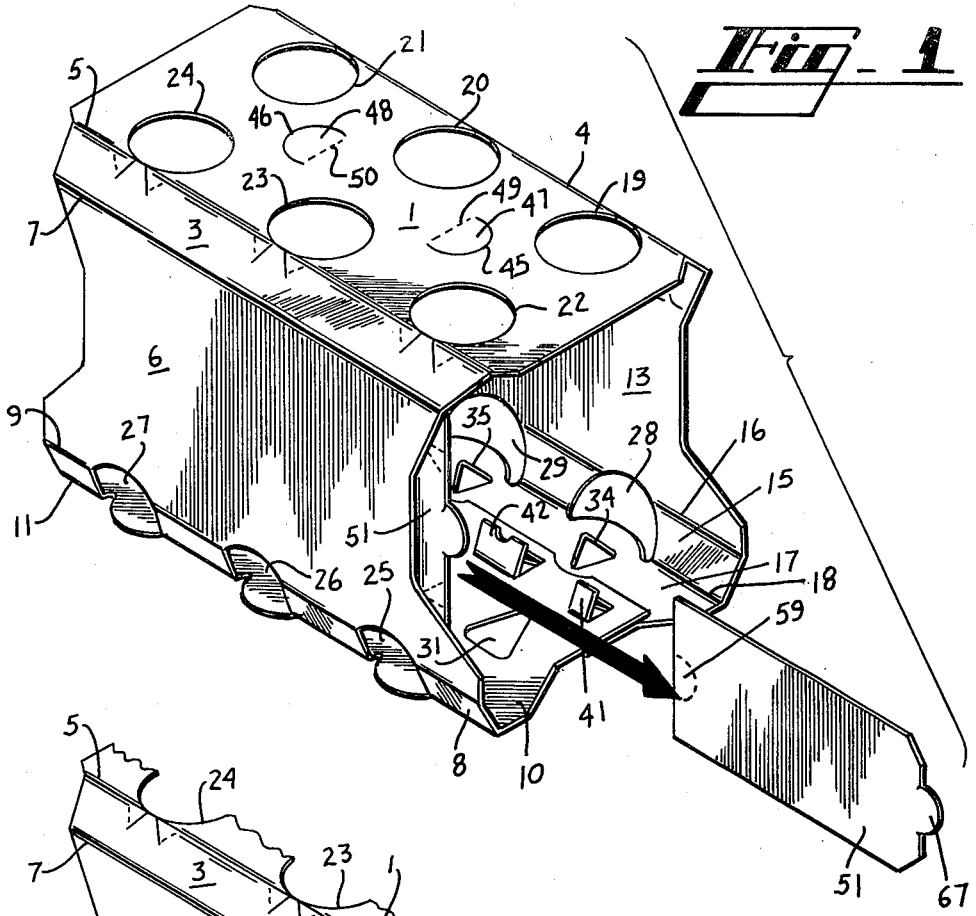
FIG. 1 is a perspective view of an aritcle carrier incorporating promotional means formed according to this invention and which shows the removable feature of the primary coupon.

With reference to the drawings and in particular FIG. 3, the numeral 1 designates the top wall of the carrier to the side edges of which upper sloping panels 2 and 3 are foldably joined respectively along fold lines 4 and 5. Side wall 6 is joined to a side edge of upper sloping panel 3 along fold line 7 and to a side edge of lower sloping panel 8 along interrupted fold line 9. In addition bottom lap panel 10 is joined to a side edge of lower sloping panel 8 along interrupted fold line 11.

Along the lower portion of upper sloping panel 2, carrier opening means 12 is formed. Also side wall 13 is joined to the lower edge 14 of opening means 12. Bottom sloping panel 15 is foldably joined to the lower edge of side wall 13 along interrupted fold line 16. To complete the basic elements of the blank, bottom lap panel 17 is foldably joined to lower sloping panel 15 along interrupted fold line 18. Of course, in the completed carrier, bottom lap panels 10 and 17 are combined to form the carrier bottom wall.

For the purpose of receiving the bottle neck portions, neck receiving apertures 19, 20, 21, 22, 23 and 24 are formed on top wall 1. In addition a pair of expansion slits a and b are associated with each neck receiving aperture 19–24 as is well known. Also heel receiving apertures 25, 26 and 27 are formed in lower sloping panel 8 and, in similar fashion, heel receiving apertures 28, 29 and 30 are formed in lower sloping panel 15.

Machine tightening apertures 31, 32, and 33 are formed in bottom lap panel 10 and machine tightening apertures 34, 35 and 36 are similarly formed in bottom lap panel 17. Locking means for the carrier is provided in the form of locking tabs 37, 38, 39 and 40 formed in bottom lap panel 17 and locking apertures 41, 42, 43 and 44 formed in bottom lap panel 10. In order to provide convenient carrying means for the carrier, finger gripping apertures 45 and 46 are formed in top wall 1. In addition finger cushioning flaps 47 and 48 are foldably joined respectively to top wall 1 along fold lines 49 and 50.

According to this invention, article carrier promotional means is provided and is shown in blank form in FIG. 4 and is generally indicated by the letter p. More specifically primary coupon 51 is foldably joined to secondary coupon 152 along fold lines 53 and 54. In addition glue flaps 55 and 56 are joined to the side edges of secondary coupon 52 respectively along tear lines 57 and 58. Also primary coupon 51 is provided with glue tab 59 which is detachably joined to primary coupon 51 by means of tear line 60.

For the purpose of facilitating separation of primary coupon 51 from secondary coupon 52, tear lines 61, 62, 63 and 64 are provided. Also glue flaps 55 and 56 are joined to primary coupon 51 respectively by means of web panels 65 and 66. Finally pull tab 67 is integrally formed along the end edge of primary coupon 51 intermediate tear lines 62 and 63.

In order to form the article carrier according to this invention initially glue is applied to glue tab 59. Then the promotional means blank is manipulated in such manner that primary coupon 51 is folded over to the right, as shown in FIG. 4, along fold lines 53 and 54 as well as along tear lines 62 and 63 and the fold lines between web panels 65 and 66 and glue flaps 55 and 56 respectively into flat face contacting relation with secondary coupon 52. By this operation, glue tab 59 is adhered to secondary coupon 52. Then an application of glue is made to glue flaps 55 and 56. Following this promotional means p is simply adhered to the inner surface of side wall 6 as shown in FIGS. 1 and 2 in such manner that pull tab 67 as well as the outer portions of primary coupon 51 and secondary coupon 52 extend beyond the end edge of side wall 6 as shown in FIG. 1.

In order to complete the article carrier, it is simply necessary to assemble six bottles in two rows of three bottles each and then place the carrier blank as shown in FIG. 3 over the articles so that the respective article necks are inserted through neck receiving apertures 19–24. Then the remaining elements of the blank are enveloped around the articles in such manner that appropriate machine elements are inserted in machine tightening apertures 31–36 in such manner so as to pull bottom lap panels 10 and 17 together in an overlapping relation. Finally locking tabs 37–40 are forced into locking apertures 41–44 respectively. This procedure is well known in the art.

Figure 2:
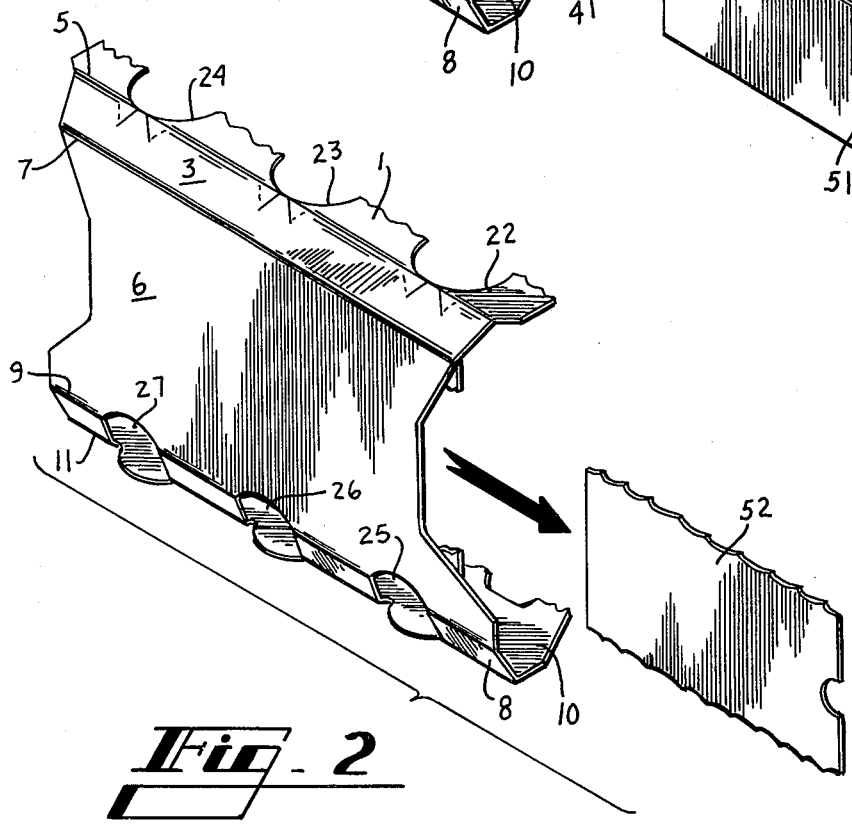
FIG. 2 is a perspective view of a portion of the article carrier and which depicts removal of the secondary coupon.

In order to activate the promotional means, the carrier, as shown in FIG. 1 when loaded with the appropriate articles, is simply presented at the point of purchase in the normal manner. Then as desired an outward force is exerted on pull tab 67 which causes a tearing action along tear lines 60–64 at which time primary coupon 51 separated from the carrier and can be redeemed in accordance with the appropriate promotion. Following this the article carrier is simply transported to its ultimate destination at which time secondary coupon 52 can be removed from the article carrier by simply separating it from side wall 6 with the consequential tearing along tear lines 57 and 58. Then secondary coupon 52 can be redeemed by mail or otherwise as desired.

INDUSTRIAL APPLICABILITY

By this invention an article carrier is provided which has a dual purpose promotional means allowing a wraparound type carrier to be used in connection with a point of purchase redemption feature in combination with a secondary feature which can be used at a subsequent time.

I claim:

1. In an article carrier comprising top, bottom and side walls interconnected to form a sleeve, promotional means comprising a primary coupon, a secondary coupon foldably joined to an end edge of said primary coupon, a pair of glue flaps joined respectively to the side edges of said secondary coupon along a pair of tear lines and being adhered to one of said walls, said primary coupon being disposed intermediate said secondary coupon and said one wall, and a pull tab being integrally joined to said primary coupon along said end edge thereof.

2. Promotional means according to claim 1 wherein said glue flaps are adhered to the inner surface of said one wall.

3. Promotional means according to claim 2 wherein said glue flaps are joined to the inner surface of one of said side walls.

4. In an article carrier comprising top, bottom and side walls interconnected to form a sleeve, promotional means comprising a primary coupon, a secondary coupon foldably joined to an edge of said primary coupon, a pair of glue flaps joined respectively to the side edges of said secondary coupon along a pair of tear lines and being adhered to one of said walls, said primary coupon being disposed intermediate said secondary coupon and said one wall, and a pair of tear lines being formed in said primary coupon and diverging respectively from said end edge to the side edges thereof.

5. In an article carrier comprising top, bottom and side walls interconnected to form a sleeve, promotional means comprising a primary coupon, a secondary coupon foldably joined to an end edge of said primary coupon, a pair of glue flaps joined respectively to the side edges of said secondary coupon along a pair of tear lines and being adhered to one of said walls, said primary coupon being disposed intermediate said secondary coupon and said one wall, and a glue tab being formed in said primary coupon remote from said end edge.

6. In an article carrier comprising top, bottom and side walls interconnected to form a sleeve, promotional means comprising a primary coupon, a secondary coupon foldably joined to an end edge of said primary coupon, a pair of glue flaps joined respectively to the side edges of said secondary coupon along a pair of tear lines and being adhered to one of said walls, said primary coupon being disposed intermediate said secondary coupon and said one wall, and a pair of web panels interconnecting respectively said glue flaps and said primary coupon along the side edges thereof adjacent said end edge.

7. A promotional means blank comprising a primary coupon, a secondary coupon foldably joined to said primary coupon, a pair of glue flaps joined respectively to the side edges of said secondary coupon by means of a pair of tear lines, and a pull tab being integrally joined to said primary coupon along the edge thereof joined to said secondary coupon and being struck from said secondary coupon.

8. A promotional means blank according to claim 7 wherein a glue tab is formed in said primary coupon remote from said pull tab.

9. A promotional means blank comprising a primary coupon, a secondary coupon foldably joined to said primary coupon, a pair of glue flaps joined respectively to the side edges of said secondary coupon by means of a pair of tear lines, and said glue flaps being joined to said primary coupon respectively by means of a pair of web panels.

10. A promotional means blank comprising a primary coupon, a secondary coupon foldably joined to said primary coupon, a pair of glue flaps joined respectively to the side edges of said secondary coupon by means of a pair of tear lines, and a pair of tear lines being formed in said primary coupon and diverging respectively from the edge thereof joined to said secondary coupon to the side edges thereof.

* * * * *